United States Patent [19]

Vardi et al.

[11] 4,313,316

[45] Feb. 2, 1982

[54] CONDENSER PURGE SYSTEM

[75] Inventors: Isaih Vardi, Rehovot; Yigal Kimchi, Ramat Gan; Jonathan Ben-Dror, Hadar Am, all of Israel

[73] Assignee: Tadiran Israel Electronics Industries Ltd., Tel Aviv, Israel

[21] Appl. No.: 150,137

[22] Filed: May 15, 1980

[30] Foreign Application Priority Data

May 16, 1979 [IL] Israel ..... 57307

[51] Int. Cl.[3] ..... F25B 43/04

[52] U.S. Cl. ..... 62/475; 62/476

[58] Field of Search ..... 62/475, 476

[56] References Cited

U.S. PATENT DOCUMENTS

| | | | |
|---|---|---|---|
| 2,160,394 | 5/1939 | Weaver | 62/475 |
| 2,180,441 | 11/1939 | Tibbetts | 62/475 |
| 2,316,104 | 4/1943 | Reiss | 62/475 |
| 2,400,137 | 5/1946 | Reid, Jr. | 62/475 X |
| 2,400,138 | 5/1946 | Buffington | 62/475 X |
| 2,722,806 | 11/1955 | Leonard, Jr. | 62/475 X |

*Primary Examiner*—Lloyd L. King

*Attorney, Agent, or Firm*—Fleit & Jacobson

[57] ABSTRACT

The present invention relates to a chiller of the type using water as refrigerant and aqueous lithium bromide or a similar compound as absorbant wherein non-condensables are purged with water vapor from the condenser to the evaporator, wherein means are provided for condensing part of the water vapor conveying the entrained non-condensables as this is conveyed to the evaporator. According to one embodiment, entrained non-condensables are contacted with a condenser tube so as to condense part of the water vapor.

1 Claim, 2 Drawing Figures

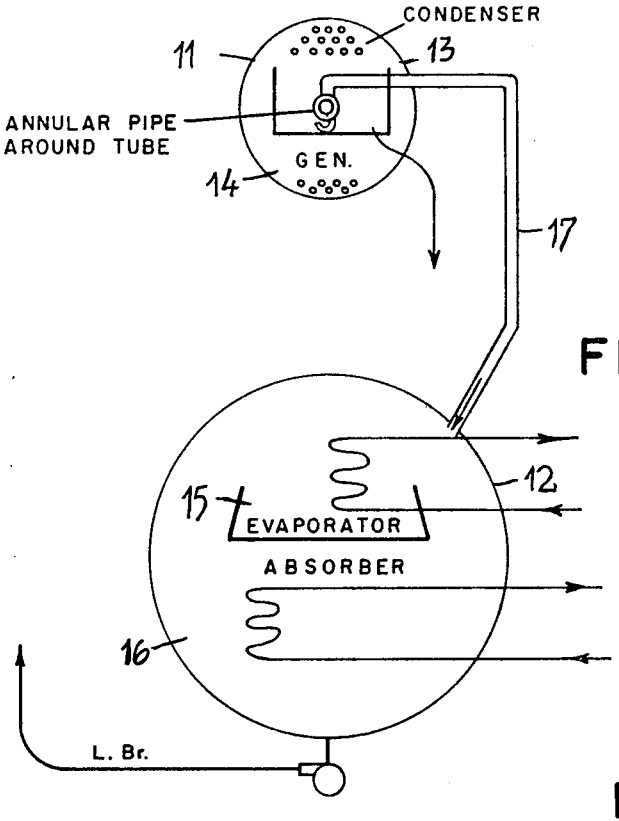
FIG. 1
FIG. 2
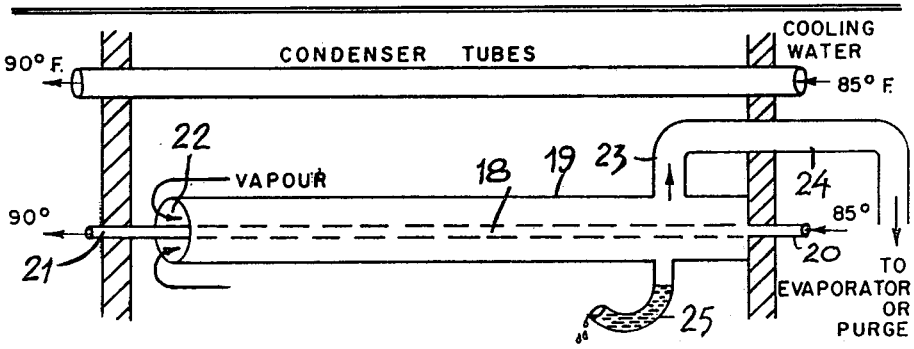

CONDENSER PURGE SYSTEM

FIELD OF THE INVENTION

The present invention relates to an improvement of the type of chillers using water as refrigerant and lithium bromide solution or the like as absorbant.

The condenser of such chillers must be purged from time to time from non-condensables and usually there is provided a special purge line leading from the condenser compartment to the evaporator. The present invention relates to improvements of such purge system.

BACKGROUND OF THE INVENTION

Chillers of the type defined above must be purged of non-condensables which tend to accumulate in the condenser section of the chiller. Such non-condensables are detrimental to the performance and efficiency of such chillers and even small quantities have a pronounced deleterious effect. Such non-condensables are generally purged via a purge line leading to the evaporator section of the chiller. Through such purge line water vapor is blown with entrained non-condensables. As the non-condensables constitute only a small portion of the vapor blown to the evaporator, such vapor constitutes a loss to the system and such losses ought to be minimized. This is of special importance with devices based on the use of solar energy where losses ought to be minimal.

SUMMARY OF THE INVENTION

According to the present invention there is provided a chiller of the type using water as refrigerant and aqueous lithium bromide, or a similar substance as absorbant, wherein a purge line is provided for purging non-condensables from the condenser section to the absorber section of the chiller, means being provided for condensing a large part of the water vapor used for blowing the non-condensables to the absorber, and for recovering the condensed water.

The arrangement of the condenser purge means according to the present invention comprises according to a preferred embodiment of the invention a condenser tube located at the lower part of the condenser tube bundle in the condenser section with another tube arranged concentrically respective said first tube, the annular space being open at the hotter end of the condenser tube towards the stream of steam and non-condensables, said water vapor moving with said non-condensables to the other colder end of said tube, a large part of the water vapor undergoing condensation within said annular space, the remaining vapor and non-condensables being led via a conduit to the absorber, the condensed liquid being drained off through a suitable trap.

DESCRIPTION OF THE PREFERRED EMBODIMENT

The invention is illustrated with reference to the enclosed schematical drawings, which are not according to scale and in which:

FIG. 1 is a schematical cross-sectional elevational view through a chiller according to the invention;

FIG. 2 illustrates the concentric tube arrangement of the purge line for purging non-condensables from the condenser to the evaporator.

DETAILED DESCRIPTION OF THE INVENTION

As shown in FIG. 1 a chiller according to the present invention comprises in combination two vessels, 11 and 12, housing respectively the condenser 13 and generator 14 in vessel 11 and the evaporator 15 and absorber 16 in vessel 12. In order to remove non-condensables from the condenser to the evaporator, there is provided a line 17 leading to the evaporator section 15. As shown in FIG. 2 a tube 18 of the condenser tube bundle, located at its lower end, is concentrically surrounded by a tube 19, the arrangement being such that cooling water enters tube 18 at its right-hand side 20 and leaves at the left hand side 21 at a higher temperature. Typical temperatures are 85° F. at the entrance and about 90° F. at the exit of such tube.

Water vapor introduced at the left hand side at 22 of the annular space between tubes 18 and 19 together with non-condensables, undergoes condensation and a part of the water vapor condenses on the inner tube as the vapor moves in said annular space towards the right hand side. At the upper end of the annular space there is provided an exit 23 and conduit 24 leading to the evaporator, through which part of the vapor and said non-condensables are purged to the evaporator, while condensed water is drained via the small liquid trap 25. The quantity of water vapor blown to the absorber is substantially reduced, while the non-condensables are purged in an efficient manner.

It is clear that this example is by way of illustration only and that many modifications and changes in the nature and arrangement of parts can be resorted to without departing from the scope and spirit of the invention.

We claim:

1. In a chiller of the type using water as a refrigerant and an aqueous lithium bromide, or a similar compound, as an absorbant, wherein non-condensable gases and water vapor are purged from a condenser comprising a tube bundle to an evaporator, the improvement which comprises:

a condenser tube having an inlet means for receiving a cold coolant thereby defining a cold end of the chiller, and an outlet means for removing a warmed coolant thereby defining a warm end of the chiller;

a concentric tube surrounding the condenser tube, thereby defining an annular space between the condenser tube and the concentric tube, said concentric tube having an inlet means at the warm end for receiving water vapor and non-condensable gas into said annular space, and an outlet means for removing condensed water at the cold end, and an outlet means for removing vapor and non-condensable gases at the cold end, said outlet means for vapor and non-condensables being in communication with said evaporator.

* * * * *